US008071020B2

(12) United States Patent
Otome et al.

(10) Patent No.: US 8,071,020 B2
(45) Date of Patent: Dec. 6, 2011

(54) HIGH STRENGTH CR-NI ALLOY MATERIAL AND SEAMLESS PIPE FOR OIL WELL

(75) Inventors: Yohei Otome, Amagasaki (JP); Masaaki Igarashi, Sanda (JP); Hisashi Amaya, Kyoto (JP); Hirokazu Okada, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 173 days.

(21) Appl. No.: 12/485,270

(22) Filed: Jun. 16, 2009

(65) Prior Publication Data

US 2009/0291017 A1 Nov. 26, 2009

Related U.S. Application Data

(63) Continuation of application No. PCT/JP2008/067791, filed on Oct. 1, 2008.

(30) Foreign Application Priority Data

Oct. 3, 2007 (JP) ..... 2007-259339

(51) Int. Cl.
*C22C 28/00* (2006.01)
*C22C 38/42* (2006.01)
*C22C 38/44* (2006.01)

(52) U.S. Cl. ..... 420/586.1; 420/40; 420/49; 420/52; 420/53; 148/327; 148/442; 148/909

(58) Field of Classification Search ..... 420/52, 420/53, 55, 49, 586.1, 40; 148/327, 449, 148/442, 909

See application file for complete search history.

(56) References Cited

U.S. PATENT DOCUMENTS 4,400,210 A * 8/1983 Kudo et al. ..... 420/443
4,400,349 A * 8/1983 Kudo et al. ..... 420/443

FOREIGN PATENT DOCUMENTS

| | | |
|---|---|---|
| JP | 57-203735 | 12/1982 |
| JP | 57-207149 | 12/1982 |
| JP | 58-210155 | 12/1983 |
| JP | 11-302801 | 11/1999 |
| JP | 2005-509751 | 4/2005 |
| WO | 2006/003953 | 1/2006 |

* cited by examiner

*Primary Examiner* — Deborah Yee
(74) *Attorney, Agent, or Firm* — Clark & Brody

(57) ABSTRACT

A high strength Cr—Ni alloy material excellent in hot workability and stress corrosion cracking resistance, and seamless pipe for oil well application which consists of, by mass percent, C: 0.05% or less, Si: 0.05 to 1.0%, Mn: 0.01% or more and less than 3.0%, P: 0.05% or less, S: 0.005% or less, Cu: 0.01 to 4%, Ni: 25% or more and less than 35%, Cr: 20 to 30%, Mo: 0.01% or more and less than 4.0%, N: 0.10 to 0.30%, Al: 0.03 to 0.30%, O (oxygen): 0.01% or less, and REM (rare earth metal): 0.01 to 0.20% with the balance being Fe and impurities, and also satisfies the conditions in the following formula (1).

$$N \times P/\mathrm{REM} \leq 0.40 \qquad \text{formula (1)}$$

where P, N, and REM in the formula (1) respectively denote the contents (mass %) of P, N, and REM. The high strength Cr—Ni alloy material may further contain one or more types of W, Ti, Nb, Zr, V, Ca, and Mg, instead of part of Fe.

8 Claims, 1 Drawing Sheet

HIGH STRENGTH CR-NI ALLOY MATERIAL AND SEAMLESS PIPE FOR OIL WELL

"This application is a continuation of International Patent Application No. PCT/JP2008/067791, filed Oct. 1, 2008. This PCT application was not in English as published under PCT Article 21(2)."

FIELD OF THE INVENTION

The present invention relates to a high strength Cr—Ni alloy material excellent in hot reduction rate and stress corrosion cracking resistance, and a seamless pipe for oil well.

BACKGROUND ART

The sharp rise in the price of crude oil in recent years has resulted in oil or gas wells being dug deeper and in severely corrosive environments. Digging deeper oil or gas wells in harsh environments requires using oil well pipes that have high strength and possess excellent corrosion resistance and stress corrosion cracking resistance.

Oil and natural gas contain corrosive substances such as carbon dioxide gas, hydrogen sulfide, and chlorine ions. Material used for drilling oil or gas wells must therefore possess excellent resistance to such corrosive substances. Stress corrosion cracking is a main corrosive factor particularly in environments at temperatures of 150° C. or higher and containing hydrogen sulfide at 1 atm or higher. High stress corrosion cracking resistance is therefore required in materials used in environments containing hydrogen sulfide.

Oil and gas wells are being drilled deeper in recent years due to the increasing demand for oil and natural gas. The materials used in these deeper oil and gas wells must possess higher strength and also provide corrosion resistance against carbon dioxide gas, hydrogen sulfide, and chlorine ions. Examples of materials possessing excellent corrosion resistance in corrosive environments are the Cr—Ni alloy materials disclosed in patent document 1, patent document 2, and patent document 3. These patent documents 1 to 3 also reveal that increasing the N content is effective in increasing the strength of Cr—Ni alloy material. A drawback, however, is that the high strength alloy reinforced in this manner might have poor hot reduction rate. In view of this problem, elements such as Ca, Mg, and Si, and REM (rare earth metal) are added to improve the hot reduction rate.

The Cr—Ni alloy material disclosed in patent document 4 reveals that reducing the Mo content improves the hot reduction rate. A problem, however, is that cold working with high reduction rate is required in the case where the N content is low and higher strength is needed, involving deterioration of ductility and toughness.

Patent document 5 discloses, as a material having excellent corrosion resistance in an acidic environment or a seawater environment as well as having excellent hot workability, a super-austenitic stainless steel with a higher Mn and Mo content, and containing Ce, Ca, or a similar element. The material disclosed in patent document 5, however, is inadequate when higher hot workability is needed. This material further has such a problem that ductility and toughness might deteriorate if the material is subjected to cold working at high reduction rate to increase the material strength.

[Patent Document 1] Japanese Unexamined Patent Publication No. S57-203735

[Patent Document 2] Japanese Unexamined Patent Publication No. S57-207149

[Patent Document 3] Japanese Unexamined Patent Publication No. S58-210155

[Patent Document 4] Japanese Unexamined Patent Publication No. H11-302801

[Patent Document 5] Japanese Unexamined Patent Publication No. 2005-509751

DISCLOSURE OF THE INVENTION

Problem to be Solved by the Invention

Thus, the conventional art failed to provide a material possessing high strength along with excellent hot workability and stress corrosion cracking resistance.

It is an object of the present invention is to provide a Cr—Ni alloy material possessing high strength while preventing deterioration in hot workability and stress corrosion cracking resistance.

Means for Solving the Problem

The inventors made an attempt to produce a material possessing higher strength than conventional material by increasing the N content. However, simply increasing the N content lowers the hot workability and stress corrosion cracking resistance, thereby failing to produce oil well seamless pipes. In view of this, the inventors came up with the idea of adding REM (rare earth metal), as a measure to prevent lowering of hot workability and stress corrosion cracking resistance that occurs due to an increased N content. The REM are known to improve the hot workability by fixing elements such as O, S, or P in the alloy. However, little attention has been directed to the influence that the REM have on the stress corrosion cracking resistance.

The inventors produced a variety of high N alloys of various chemical compositions and evaluated the performance of the alloys. The inventors consequently found that adding REM improves the stress corrosion cracking resistance. The cause of REM improving stress corrosion cracking resistance is possibly that REM fixes P, which adversely affects the stress corrosion cracking resistance.

It was found that the high N alloy containing REM encounters deterioration of hot workability even when containing elements such as Ca, Mg, or Si, which are conventionally deemed effective in improving hot workability. A further intensive study revealed that satisfactory hot workability can be obtained even in high N alloys containing REM by adding Al. The inventors therefore realized that adding X into the high N alloy containing REM is essential for obtaining the desired hot workability.

Working from the above new knowledge the inventors obtained the further findings (a) to (f) as a result of additional study and experiments.

(a) In the Cr—Ni alloy material, the content of N must be as high as 0.10 to 0.30% to obtain high strength and the content of Al must be set from 0.03 to 0.3% to secure hot workability.

(b) Increasing the content of N in the Cr—Ni alloy material between 0.10 and 0.30% lowers the hot workability and stress corrosion cracking resistance.

(c) However, fixing the P in the alloy as a P compound by containing REM into the alloy not only improves the hot workability but also improves the stress corrosion cracking resistance.

(d) In view of the above, the content of REM can be set in terms of the amount required for fixing the P as a P compound. In other words, [P/REM], content ratio of P to REM, is crucial.

(e) The smaller the [P/REM] value, the greater the effect on suppressing adverse effects from P on hot workability. Deterioration in the hot workability can therefore be suppressed even with a high N content.

(f) A Cr—Ni alloy material possessing satisfactory stress corrosion cracking resistance can therefore be obtained by specifying a relation among the contents of N, P, and REM to satisfy the following formula (1).

$$N \times P/\mathrm{REM} \leqq 0.40 \qquad \text{formula (1)}$$

where P, N, and REM in the formula (1) respectively denote the contents (mass %) of P, N, and REM.

FIG. 1 is a graph of Cr—Ni alloy materials of a variety of chemical compositions, Alloy Nos. 1 to 30 of the present invention and Alloy Nos. L to S of the comparative, which were used in the example described later, and where the content of N is plotted along the X axis, and [P/REM], content ratio of P to REM, is plotted along the Y axis.

As is obvious from FIG. 1, the present invention and the comparative are distinguished from each other across the curve indicating "N×P/REM=0.40" within the range of 0.10 to 0.30% for the content of N, which is necessary for securing strength. Specifically, as will be described later in the example, the present invention where the content of N is from 0.10 to 0.30% and the relation among the contents of N, P and REM satisfies the formula (1), it possesses satisfactory hot workability and stress corrosion cracking resistance in addition to high strength. The present invention is, therefore, Cr—Ni alloy materials possessing high strength, excellent hot workability, and stress corrosion cracking resistance.

The present invention was accomplished based on the above findings and is summarized into Cr—Ni alloy materials described in the following (1) to (5) and an oil well seamless pipe described in the following (6). These aspects of the present invention as the Cr—Ni alloy materials described in the following (1) to (5), and the oil well seamless pipe described in the following (6) are respectively referred to as "the present invention (1)" to "the present invention (6)", and the present inventions (1) to (6) may also be collectively referred to as "the present invention".

(1) A high strength Cr—Ni alloy material which consists of, by mass percent, C: 0.05% or less, Si: 0.05 to 1.0%, Mn: 0.01% or more and less than 3.0%, P: 0.05% or less, S: 0.005% or less, Cu: 0.01 to 4%, Ni: 25% or more and less than 35%, Cr: 20 to 30%, Mo: 0.01% or more and less than 4.0%, N: 0.10 to 0+30%, Al: 0.03 to 0.30%, O (oxygen): 0.01% or less, and REM (rare earth metal): 0.01 to 0.20%, with the balance being Fe and impurities, and also satisfies the conditions in the following formula (1).

$$N \times P/\mathrm{REM} \leqq 0.40 \qquad \text{formula (1)}$$

where P, N, and REM in the formula (1) respectively denote the contents (mass %) of P, N, and REM.

(2) The high strength Cr—Ni alloy material according to (1) above, characterized by further containing, by mass percent, W: at less than 8.0% instead of part of Fe.

(3) The high strength Cr—Ni alloy material according to (1) or (2) above, characterized by further containing, instead of part of Fe, one or more selected from Ti, Nb, Zr, and V at a total of 0.5% or less by mass percent.

(4) The high strength Cr—Ni alloy material according to any one of (1) to (3) above, characterized by further containing, instead of part of Fe, either or both selected from Ca and Mg at a total of 0.01% or less by mass percent.

(5) The high strength Cr—Ni alloy material according to any one of (1) to (4) above, in which the high strength Cr—Ni alloy material has a yield strength of 900 MPa or more at 0.2% proof stress after cold working.

(6) An oil well seamless pipe made of the high strength Cr—Ni alloy material according to any one of (1) to (5) above.

Effects of the Invention

The present invention provides an oil well seamless pipe possessing high strength and excellent hot workability and corrosion resistance because deterioration in the hot workability and stress corrosion cracking resistance is prevented even when the Cr—Ni alloy material is increased in strength by an increased N content.

BEST MODE FOR CARRYING OUT THE INVENTION

Reasons for limiting the chemical compositions of the Cr—Ni alloy material of this invention are described below. It should be noted that the symbol "%" for the content of each element indicates the "mass %".

C: 0.05% or less

C is contained as an impurity. A content of C in excess of 0.05% is prone to cause stress corrosion cracking along with grain boundary breakage involving precipitation of $M_{23}C_6$ carbides (where M is an element such as Cr, Mo, and Fe). In view of this, the content of C upper limit is set to 0.05%. The upper limit is preferably set to 0.03%.

Si: 0.05 to 1.0%

Si is a necessary component for deoxidization. However, a content of Si below 0.05% fails to provide a sufficient deoxidizing effect. On the other hand, a content of Si in excess of 1% might cause poor hot workability. In view of this, the Si content is set from 0.05 to 1.0%. Preferably it is set from 0.05 to 0.5%.

Mn: 0.01% or more and less than 3.0%

Mn is a necessary component for deoxidization or as a desulfurizing agent. However, a content of Mn below 0.01% fails to provide sufficient effects. On the other hand, a content of Mn of 3.0% or more might lower the hot workability. In view of this, the content of Mn is set to 0.01% or more and less than 3.0%. Preferably it is set to 0.1% or more and less than 2.0%. More preferably it is set from 0.2% to 1.0%.

P: 0.05% or less

P is an impurity in the alloy and might drastically lower the hot workability and stress corrosion cracking resistance. In view of this, the upper limit of the content of P is set to 0.05%. Preferably the upper limit is set to 0.03%.

S: 0.005% or less

S, like P, is an impurity that might drastically lower the hot workability. The S content should be reduced as much as possible to prevent lowering of the hot workability. An allowable upper limit of the content of S is 0.005%. Preferably it is 0.002%, and still more preferably it is 0.001%.

Cu: 0.01 to 4.0%

Cu has the effect of stabilizing the passivation layer formed on the alloy surface and is necessary for improving the pitting resistance and general corrosion resistance. However, a content of Cu below 0.01% provides no substantial effect, and a content of Cu in excess of 4.0% might lower the hot workability. In view of this, the content of Cu is set from 0.01 to 4.0%. Preferably it is set from 0.1 to 2.0%. More preferably it is set from 0.6 to 1.4%.

Ni: 25% or more and less than 35%

Ni is an austenite stabilizing element. A content of Ni of 25% or more is preferable for corrosion resistance. However, a content of Ni of 35% or more might lead to higher manufacturing costs. In view of this, the Ni content is 25% or more and less than 35%. Preferably it is 28% or more and less than 33%.

Cr: 20 to 30%

Cr is a component that remarkably improves the stress corrosion cracking resistance. However, a content of Cr below 20% fails to provide a sufficient effect. On the other hand, a content of Cr in excess of 30% might cause formation of nitrides such as CrN and $Cr_2N$, or $M_{23}C_6$ carbides, which might cause stress corrosion cracking involving grain boundary breakage. In view of this, the content of Cr is set from 20 to 30%. Preferably it is set from 23 to 28%.

Mo: 0.01% or more and less than 4.0%

Mo, like Cu, has the effect of stabilizing the passivation layer formed on an alloy surface, and the effect of improving the stress corrosion cracking resistance. However, a content of Mo below 0.01% provides no substantial effect. A Mo content of 4% or more, on the other hand, might lower the hot workability and increase the cost. In view of this, the content of Mo is 0.01% or more and less than 4.0%. Preferably it is 0.1% or more and less than 3.5%.

N: 0.10 to 0.30%

N is an important element in the present invention. N has the effect of increasing the strength of the alloy. However, an N content below 0.10% fails to secure the intended high strength. A content of N in excess of 0.30%, on the other hand, might lower the hot workability and stress corrosion cracking resistance. In view of this, the content of N is set from 0.10 to 0.30%. The content of N is preferably set from 0.16 to 0.25%. The content of N must satisfy formula (1) in terms of its relation to the contents of P and REM.

Al: 0.03 to 0.30%

Al is an important element in the present invention. Al has the effect of preventing oxidation of the REM, as well as improving the hot workability by fixing O (oxygen) in the alloy. Since a large amount of inclusions are formed in an alloy containing REM but not containing Al, the hot workability might drastically lower. Accordingly, the alloy must also include Al in the case where the alloy includes REM. However, a content of Al below 0.03% fails to provide a sufficient effect. On the other hand, a content of Al in excess of 0.30% might lower the hot workability. In view of this, the content of Al is set from 0.03 to 0.30%. Preferably it is set in excess of 0.05% and 0.30% or less. More preferably it is set in excess of 0.10% and 0.20% or less.

O (Oxygen): 0.01% or less

O is an impurity in the alloy and might drastically lower the hot workability. In view of this, the upper limit of O (oxygen) content is set to 0.01%, and preferably the upper limit is set to 0.005%.

REM: 0.01 to 0.20%

REM is an important element in the present invention. REM is added because of the effect of improving the hot workability and stress corrosion cracking resistance. However, since REM is easily oxidized, it is essential that Al be included along with REM. A total content of REM below 0.01% fails to provide a sufficient effect. On the other hand, a total content of REM in excess of 0.20% fails to provide an improvement in hot workability and stress corrosion cracking resistance, and might rather lower the hot workability and stress corrosion cracking resistance. In view of this, the content of REM is set from 0.01 to 0.20%, and preferably is set from 0.02 to 0.10%.

In the present invention, the term "REM" indicates one or more of seventeen elements including Sc, Y, and lanthanoid. One or more of these elements may be added. Industrially, it may be added in the form of mish metal.

$$N \times P/\mathrm{REM} \leqq 0.40 \qquad \text{formula (1)}$$

In this formula, P, N, and REM respectively denote the contents (mass %) of P, N, and REM.

In the case where the content of N is from 0.10 to 0.30% and the relation among the contents of N, P, and REM satisfies the formula (1), satisfactory hot workability and stress corrosion cracking resistance are obtained in addition to high strength. In the case where even better stress corrosion cracking resistance is required, N×P/REM≦0.30" is preferable. More preferably it is "N×P/REM≦0.20".

In addition to the above alloy elements, the Cr—Ni alloy material of the present invention may contain one type or two or more types of elements selected from at least one group of the following first to third groups.

First group: W: less than 8.0%.

Second group: Ti, Nb, V, Zr: 0.5% or less.

Third group: Ca, Mg: 0.01% or less.

These optional elements are described in detail as follows.

First Group: W: Less than 8.0%

W may be included if necessary. W is effective in improving the stress corrosion cracking resistance. However, a content of W of 8.0% or more might lower the hot workability to the detriment of economy. In view of this, the upper limit of the content of W is set to 8.0%, in the case where W is contained. The content of W is preferably set to 0.01% or more to reliably obtain the stress corrosion cracking resistance effect. Preferably it is set 0.1% or more and less than 7.0%.

Second group: 0.5% of one or more of the types selected from Ti: 0.5% or less, Nb: 0.5% or less, V: 0.5% or less, and Zr: 0.5% or less, or a combination of the above at 0.5% in total The Ti, Nb, V, or Zr may be included if necessary. Containing one or more of these elements is effective in forming fine grains of crystal and improving ductility. These elements may therefore be included if further ductility is required. However, an alloy where the content of these elements exceeds 0.5% might result in forming a large amount of inclusions and might lower ductility. In view of this, the upper limit for the total content of these elements is set to 0.5%. The content of these elements is preferably set to 0.005% or more singly or in combination to reliably obtain the effect of improving ductility. More preferably is set from 0.01 to 0.5%, and still more preferably is set from 0.05 to 0.3%.

Third group: either or both selected from Ca: 0.01% or less and Mg: 0.01% or less Ca or Mg may be included if necessary. Including either of both of these elements is effective in improving the hot workability.

However, an element content in excess of 0.01% might result in formation of large-sized inclusions, and might lower the hot workability. In view of this, the upper limit for the total content of these elements is set to 0.01%. The content of these elements is preferably 0.0003% or more singly or in combination to reliably obtain the effect of improving hot workability. More preferably it is set between 0.0003 to 0.01%. Still more preferably it is set from 0.0005 to 0.005%.

The seamless pipe of the present invention contains the above essential elements, or further contains the above optional elements, with the balance being Fe and impurities.

Seamless pipes made from Cr—Ni alloy material for use in deep oil or gas wells must possess a yield strength of 900 MPa or more at 0.2% proof stress, and more preferably a yield strength of 964 MPa or more. In order to produce a Cr—Ni alloy material having a yield strength of 900 MPa or more, a manufacturing process is preferably performed where a cold-worked material produced by hot working is preferably subjected to solution treatment and then further processed by cold working.

The Cr—Ni alloy material according to the present invention may be melted in an electric furnace, an AOD furnace, a VOD furnace, or a similar device. In the case where a molten material of the material is cast into ingots, the ingots may be forged into slabs, blooms, or billets. Alternatively, a molten material of the material may be formed into slabs, blooms, or billets by a continuous casting method. In the case where the Cr—Ni alloy material according to the present invention is processed into a plate material, the material may be subjected to hot rolling into a plate or coil shape. In the case where the Cr—Ni alloy material according to the present invention is processed into pipe material, the material may be hot worked into a pipe shape by a hot extrusion process or a Mannesmann mandrel mill process.

In order to obtain a high strength Cr—Ni alloy material possessing the above described the yield strength, a hot worked material is preferably subjected to solution heat treatment, followed by cold rolling, in the case of a plate material; or a hot worked material is subjected to solution heat treatment, followed by cold working such as cold drawing or cold rolling including Pilger rolling into a pipe material, in the case of a pipe material. Cold working may be performed one or more times. Alternatively, the cold working may be performed one or more times, as needed after heat treatment.

High strength Cr—Ni alloy pipe obtained by cold working and possessing a yield strength of 900 MPa or more is satisfactory as an oil well seamless pipe for deep oil or gas wells. In the case where cold drawing is performed as the final cold working after hot solution treatment, the reduction rate of cold working is preferably 20 to 35% as a cross sectional area reduction rate. If the reduction rate of cold working is less than 20%, then obtaining the intended high strength might not be possible. On the other hand, if the reduction rate of cold working exceeds 35%, then the ductility and toughness might become lower, even though high strength is secured.

EXAMPLE 1

Table 1 shows chemical compositions (mass %) of the present invention (Alloy Nos. 1 to 30), and Table 2 shows chemical compositions (mass %) of the comparative (Alloy Nos. A to S). Alloy Nos. 1 to 29 serving as the present invention and Alloy Nos. A to S serving as the comparative are 50 kg ingots of 180 mm in outer diameter produced through melting in a vacuum induction furnace and ingot casting. Each ingot was subjected to hot forging, followed by hot rolling into a plate material of 15 mm thick. The plate material was then subjected to solution treatment under the conditions of heating and holding at 1050° C. for 1 hour and cooling in cold water. The plate material was then subjected to cold rolling at a cross sectional area reduction rate of 40%, thus obtaining the alloy materials serving as the present invention and the comparative.

TABLE 1

| | Alloy | Chemical composition (mass %, the balance: Fe and impurities) | | | | | | | | | | | | | | | |
|---|---|---|---|---|---|---|---|---|---|---|---|---|---|---|---|---|---|
| | No. | C | Si | Mn | P | S | Cu | Ni | Cr | Mo | W | N | Al | Ca | O | REM | others |
| The invention | 1 | 0.020 | 0.23 | 0.65 | 0.017 | 0.0008 | 0.81 | 32.75 | 25.07 | 2.99 | — | 0.199 | 0.12 | 0.0006 | 0.003 | 0.015Nd | |
| | 2 | 0.011 | 0.27 | 0.64 | 0.018 | 0.0005 | 0.79 | 32.16 | 25.16 | 3.03 | — | 0.190 | 0.14 | 0.0019 | 0.002 | 0.022Nd | |
| | 3 | 0.025 | 0.17 | 1.86 | 0.017 | 0.0010 | 0.79 | 32.09 | 24.63 | 2.95 | — | 0.197 | 0.09 | 0.0021 | 0.002 | 0.042Nd | 0.02Zr |
| | 4 | 0.016 | 0.26 | 0.60 | 0.017 | 0.0019 | 0.80 | 32.22 | 24.85 | 2.97 | — | 0.205 | 0.10 | 0.0009 | 0.001 | 0.130Nd | |
| | 5 | 0.011 | 0.26 | 0.63 | 0.020 | 0.0007 | 0.79 | 32.09 | 25.15 | 3.02 | — | 0.248 | 0.07 | 0.0016 | 0.002 | 0.015Nd | 0.01Nb |
| | 6 | 0.010 | 0.15 | 0.09 | 0.017 | 0.0006 | 1.96 | 29.40 | 25.20 | 2.85 | — | 0.193 | 0.13 | 0.0019 | 0.002 | 0.031Nd | |
| | 7 | 0.010 | 0.07 | 0.59 | 0.018 | 0.0008 | 3.54 | 31.30 | 24.80 | 1.21 | — | 0.205 | 0.04 | 0.0021 | 0.001 | 0.011Nd | |
| | 8 | 0.011 | 0.27 | 0.61 | 0.021 | 0.0006 | 3.24 | 34.20 | 24.93 | 0.26 | — | 0.200 | 0.08 | 0.0018 | 0.003 | 0.015Nd | |
| | 9 | 0.012 | 0.16 | 0.60 | 0.010 | 0.0005 | 0.79 | 26.50 | 24.88 | 3.08 | — | 0.190 | 0.11 | 0.0023 | 0.001 | 0.019Nd | 0.03V |
| | 10 | 0.011 | 0.16 | 0.60 | 0.017 | 0.0004 | 0.11 | 33.50 | 24.97 | 2.93 | — | 0.200 | 0.13 | 0.0022 | 0.002 | 0.023Nd | |
| | 11 | 0.012 | 0.18 | 0.57 | 0.018 | 0.0009 | 0.80 | 31.88 | 21.90 | 3.03 | — | 0.199 | 0.12 | 0.0021 | 0.003 | 0.010La + 0.012Ce | |
| | 12 | 0.011 | 0.14 | 0.58 | 0.018 | 0.0008 | 0.79 | 32.13 | 28.50 | 2.90 | — | 0.165 | 0.09 | 0.0019 | 0.003 | 0.010Nd | 0.02Ti |
| | 13 | 0.011 | 0.26 | 0.59 | 0.020 | 0.0004 | 0.78 | 31.92 | 25.06 | 3.52 | — | 0.197 | 0.12 | 0.0019 | 0.004 | 0.024Nd | |
| | 14 | 0.011 | 0.28 | 0.60 | 0.021 | 0.0004 | 0.80 | 31.93 | 25.10 | 0.40 | 6.42 | 0.201 | 0.11 | 0.0018 | 0.001 | 0.011Nd | |
| | 15 | 0.012 | 0.21 | 0.61 | 0.017 | 0.0004 | 0.79 | 32.02 | 25.04 | 0.40 | 2.50 | 0.202 | 0.13 | 0.0018 | 0.002 | 0.023Nd | |
| | 16 | 0.011 | 0.15 | 0.61 | 0.022 | 0.0006 | 0.79 | 32.08 | 25.18 | 2.50 | 1.20 | 0.205 | 0.10 | 0.0019 | 0.004 | 0.024Nd | |
| | 17 | 0.012 | 0.12 | 2.73 | 0.021 | 0.0008 | 0.80 | 32.13 | 24.83 | 3.08 | — | 0.282 | 0.13 | 0.0018 | 0.001 | 0.020Nd + 0.012Ce | |
| | 18 | 0.011 | 0.48 | 0.15 | 0.021 | 0.0008 | 0.82 | 32.15 | 28.60 | 3.05 | — | 0.191 | 0.12 | 0.0018 | 0.003 | 0.025Nd | |
| | 19 | 0.011 | 0.30 | 0.61 | 0.018 | 0.0004 | 0.79 | 32.18 | 24.98 | 2.99 | — | 0.200 | 0.06 | 0.0018 | 0.004 | 0.033Nd | 0.0025Mg |
| | 20 | 0.011 | 0.11 | 0.57 | 0.019 | 0.0005 | 0.79 | 31.89 | 24.89 | 2.94 | — | 0.200 | 0.16 | 0.0021 | 0.001 | 0.029Nd | |
| | 21 | 0.010 | 0.26 | 0.62 | 0.022 | 0.0006 | 0.81 | 32.15 | 24.91 | 2.97 | — | 0.199 | 0.16 | — | 0.001 | 0.035Nd | |
| | 22 | 0.011 | 0.16 | 0.62 | 0.019 | 0.0004 | 0.80 | 32.30 | 25.15 | 3.00 | — | 0.190 | 0.10 | 0.0017 | 0.001 | 0.016Y | |
| | 23 | 0.011 | 0.27 | 0.62 | 0.030 | 0.0004 | 0.79 | 32.31 | 24.96 | 3.02 | — | 0.197 | 0.10 | 0.0019 | 0.003 | 0.015La | |
| | 24 | 0.042 | 0.27 | 0.62 | 0.018 | 0.0003 | 0.79 | 32.09 | 24.90 | 3.00 | — | 0.201 | 0.10 | 0.0019 | 0.002 | 0.020Ce | |
| | 25 | 0.035 | 0.27 | 0.61 | 0.018 | 0.0004 | 0.79 | 32.41 | 24.87 | 3.02 | — | 0.203 | 0.09 | 0.0019 | 0.003 | 0.015Sm | |
| | 26 | 0.010 | 0.17 | 0.62 | 0.018 | 0.0004 | 0.78 | 32.09 | 24.54 | 3.01 | — | 0.192 | 0.10 | 0.0019 | 0.004 | 0.024Pr | |
| | 27 | 0.011 | 0.10 | 0.63 | 0.019 | 0.0005 | 0.79 | 32.15 | 25.14 | 3.04 | — | 0.115 | 0.11 | 0.0023 | 0.002 | 0.018Nd | |
| | 28 | 0.011 | 0.10 | 0.62 | 0.030 | 0.0004 | 0.79 | 32.31 | 24.96 | 3.02 | — | 0.142 | 0.10 | 0.0019 | 0.003 | 0.012La | |
| | 29 | 0.010 | 0.10 | 0.62 | 0.018 | 0.0003 | 0.79 | 32.09 | 24.90 | 3.00 | — | 0.154 | 0.10 | 0.0016 | 0.002 | 0.020Nd | |
| | 30 | 0.014 | 0.26 | 0.57 | 0.023 | 0.0002 | 0.84 | 30.55 | 25.05 | 2.78 | 0.05 | 0.206 | 0.12 | 0.0014 | 0.002 | 0.030Nd | |

TABLE 2

| | Alloy | Chemical composition (mass %, the balance: Fe and impurities) | | | | | | | | | | | | | | | |
|---|---|---|---|---|---|---|---|---|---|---|---|---|---|---|---|---|---|
| | No. | C | Si | Mn | P | S | Cu | Ni | Cr | Mo | W | N | Al | Ca | O | REM | others |
| The comparative | A | 0.010 | 0.12 | 0.61 | 0.017 | 0.0010 | 0.82 | 32.56 | 25.14 | 2.98 | — | 0.065 | 0.10 | 0.0021 | 0.005 | — | |
| | B | 0.010 | 0.29 | 0.60 | 0.015 | 0.0010 | 0.79 | 32.90 | 25.11 | 3.01 | — | 0.164 | 0.10 | 0.0023 | 0.005 | — | |
| | C | 0.010 | 0.15 | 0.61 | 0.018 | 0.0012 | 0.79 | 32.81 | 25.05 | 2.99 | — | 0.240 | 0.11 | 0.0019 | 0.004 | — | |
| | D | 0.012 | 0.14 | 0.57 | 0.019 | 0.0005 | 0.80 | 32.21 | 25.26 | 2.98 | — | 0.174 | 0.11 | 0.0021 | 0.002 | 0.003Nd | |
| | E | 0.012 | 0.10 | 0.57 | 0.019 | 0.0005 | 0.79 | 32.21 | 25.26 | 2.98 | — | 0.220 | 0.11 | 0.0018 | 0.002 | 0.002Nd | |
| | F | 0.012 | 0.25 | 0.63 | 0.018 | 0.0005 | 0.82 | 32.21 | 25.26 | 2.98 | — | 0.177 | 0.11 | 0.0021 | 0.002 | 0.007Nd | |
| | G | 0.011 | 0.11 | 0.62 | 0.018 | 0.0005 | 0.82 | 32.31 | 25.30 | 3.03 | — | 0.162 | 0.12 | 0.0021 | 0.001 | 0.300Nd | |
| | H | 0.011 | 0.10 | 0.62 | 0.020 | 0.0004 | 0.80 | 32.12 | 25.09 | 2.94 | — | 0.166 | — | 0.0019 | 0.024 | 0.037Nd | |
| | I | 0.011 | 0.19 | 0.61 | 0.021 | 0.0003 | 0.82 | 32.12 | 24.83 | 2.95 | — | 0.205 | 0.01 | 0.0018 | 0.024 | 0.027Nd | |
| | J | 0.011 | 0.27 | 0.62 | 0.018 | 0.0006 | 0.82 | 32.01 | 24.97 | 3.07 | — | 0.192 | 0.02 | 0.0019 | 0.024 | 0.017Nd | |
| | K | 0.011 | 0.13 | 0.61 | 0.020 | 0.0007 | 0.81 | 21.40 | 24.80 | 2.96 | — | 0.204 | 0.11 | 0.0019 | 0.004 | 0.038Nd | |
| | L | 0.010 | 0.12 | 0.61 | 0.024 | 0.0009 | 0.80 | 32.19 | 24.87 | 2.94 | — | 0.192 | 0.14 | 0.0023 | 0.002 | 0.010Nd | |
| | M | 0.010 | 0.26 | 0.62 | 0.021 | 0.0004 | 0.81 | 32.19 | 24.88 | 2.99 | — | 0.203 | 0.12 | 0.0022 | 0.002 | 0.010Nd | |
| | N | 0.011 | 0.22 | 0.62 | 0.025 | 0.0006 | 0.79 | 31.91 | 25.19 | 3.05 | — | 0.210 | 0.07 | 0.0021 | 0.002 | 0.011Nd | |
| | O | 0.011 | 0.20 | 0.58 | 0.023 | 0.0003 | 0.79 | 31.87 | 25.17 | 2.92 | — | 0.282 | 0.12 | 0.0023 | 0.003 | 0.012Nd | |
| | P | 0.011 | 0.13 | 0.60 | 0.042 | 0.0008 | 0.78 | 32.05 | 24.89 | 2.91 | — | 0.164 | 0.12 | 0.0019 | 0.003 | 0.013Nd | |
| | Q | 0.011 | 0.19 | 0.63 | 0.035 | 0.0006 | 0.81 | 32.11 | 24.81 | 3.04 | — | 0.212 | 0.11 | 0.0018 | 0.001 | 0.012Nd | |
| | R | 0.011 | 0.16 | 0.61 | 0.045 | 0.0005 | 0.81 | 31.92 | 25.05 | 3.02 | — | 0.236 | 0.08 | 0.0021 | 0.003 | 0.014Nd | |
| | S | 0.010 | 0.28 | 0.57 | 0.049 | 0.0007 | 0.79 | 31.88 | 24.99 | 3.05 | — | 0.275 | 0.14 | 0.0018 | 0.003 | 0.015Nd | |

Alloy No. 30 serving as an inventive example, however, was melted in an electric furnace and cast into a 6 ton ingot. The ingot was subjected to blooming, and formed into a pipe of 238 mm in outer diameter and 22 mm thick by hot extrusion. The pipe was then subjected to cold drawing into a pipe of 194 mm in outer diameter and 12 mm thick, and then subjected to solution treatment under the conditions of heating and holding at 1090° C. for 5 minutes and cooling in cold water. The pipe was subjected to cold drawing at a cross sectional area reduction rate of 28%, thus obtaining Alloy No. 30-a serving as the present invention.

In order to compare pipe material performance and plate material performance with each other, a plate material was cut out of the ingot of Alloy No. 30 serving as the present invention, and then subjected to hot forging followed by hot rolling into a plate material of 1 mm thick. The plate material was then subjected to solution treatment under the conditions of heating and holding at 1050° C. for 1 hour and cooling in cold water. The plate material was then subjected to cold rolling at a cross sectional area reduction rate of 40%, thus obtaining Alloy No. 30-b serving as the present invention.

Test pieces of 10 mm in diameter and 130 mm in length were cut along longitudinal direction, respectively, out of the hot rolled plate and out of the bloomed billet, and then subjected to a hot tensile test to evaluate the hot workability of these alloys. The test was performed by heating the test pieces to 1250° C. in 3 minutes, holding the heated state for 3 minutes, cooling the test pieces to the respective temperatures of 1250° C., 1200° C., 1100° C., and 1000° C. at a temperature reduction rate of 100° C./sec and then subjecting the test pieces to tensile rupture at a strain rate of 10 $sec^{-1}$. The cross sectional area reduction rates of the materials subjected to tensile rupture were used as indexes of hot workability. A ruptured material with a cross sectional area reduction rate of 70% or more at all the temperatures above was judged to be GOOD (○) in hot workability, while a ruptured material with a cross sectional area reduction rate less than 70% at any of the temperatures above was judged to be POOR (x) in hot workability.

Test pieces of 6 mm in diameter and 40 mm in length were cut along longitudinal direction, respectively, out of the cold rolled plate and out of the cold drawn pipe, and then subjected to a tensile test at room temperature and in ambient air to measure the 0.2% proof stress. Test pieces of 3.81 mm in diameter and 25.4 mm in length were cut along longitudinal direction, respectively, out of the cold rolled plate above and out of the cold drawn pipe above, and then subjected to a tensile test at low strain rate to evaluate the stress corrosion cracking resistance. The tensile test at low strain rate was performed by subjecting the materials to tensile rupture at a strain rate of $4\times10^4$ $sec^{-1}$ in a corrosive environment of 25% NaCl+0.5% $CH_3COOH$+7 atm $H_2S$ at 177° C. to measure the cross sectional area reduction rate of the ruptured materials. Likewise, a tensile test at a low strain rate was performed in an inert environment to measure the cross sectional area reduction rate of the ruptured materials. The ratio of the cross sectional area reduction rate in the corrosive environment to that in the inactive environment was used as an index of the stress corrosion cracking resistance. A material having the ratio above of 0.8 or more was judged to be GOOD (○) in stress corrosion cracking resistance, while a material having the ratio above of less than 0.8 was judged to be POOR (x) in stress corrosion cracking resistance.

Table 3 shows the yield stresses at 0.2% proof stress, results of the hot workability test and the stress corrosion cracking resistance test, and the values for N×P/REM in the present invention. Table 4 shows the yield stresses at 0.2% proof stress, results of the hot workability test and the stress corrosion cracking resistance test, and the values for N×P/REM in the comparative (Alloy Nos. A to S).

TABLE 3

| | Alloy No. | Shape | 0.2% proof stress (MPa) | Hot workability | Stress corrosion cracking resistance | N × P/REM |
|---|---|---|---|---|---|---|
| The invention | 1 | plate | 1029 | ○ | ○ | 0.23 |
| | 2 | plate | 1034 | ○ | ○ | 0.16 |
| | 3 | plate | 986 | ○ | ○ | 0.08 |
| | 4 | plate | 997 | ○ | ○ | 0.03 |

TABLE 3-continued

| Alloy No. | Shape | 0.2% proof stress (MPa) | Hot workability | Stress corrosion cracking resistance | N × P/REM |
|---|---|---|---|---|---|
| 5 | plate | 1100 | ○ | ○ | 0.33 |
| 6 | plate | 1020 | ○ | ○ | 0.11 |
| 7 | plate | 1062 | ○ | ○ | 0.34 |
| 8 | plate | 1052 | ○ | ○ | 0.29 |
| 9 | plate | 997 | ○ | ○ | 0.10 |
| 10 | plate | 1014 | ○ | ○ | 0.15 |
| 11 | plate | 1052 | ○ | ○ | 0.16 |
| 12 | plate | 989 | ○ | ○ | 0.30 |
| 13 | plate | 1012 | ○ | ○ | 0.16 |
| 14 | plate | 1032 | ○ | ○ | 0.37 |
| 15 | plate | 1027 | ○ | ○ | 0.15 |
| 16 | plate | 1041 | ○ | ○ | 0.19 |
| 17 | plate | 1176 | ○ | ○ | 0.19 |
| 18 | plate | 1022 | ○ | ○ | 0.16 |
| 19 | plate | 1022 | ○ | ○ | 0.11 |
| 20 | plate | 1032 | ○ | ○ | 0.13 |
| 21 | plate | 1026 | ○ | ○ | 0.12 |
| 22 | plate | 1000 | ○ | ○ | 0.23 |
| 23 | plate | 1010 | ○ | ○ | 0.39 |
| 24 | plate | 1042 | ○ | ○ | 0.18 |
| 25 | plate | 1061 | ○ | ○ | 0.24 |
| 26 | plate | 1027 | ○ | ○ | 0.14 |
| 27 | plate | 941 | ○ | ○ | 0.12 |
| 28 | plate | 954 | ○ | ○ | 0.36 |
| 29 | plate | 970 | ○ | ○ | 0.14 |
| 30-a | pipe | 1012 | ○ | ○ | 0.16 |
| 30-b | plate | 998 | ○ | ○ | 0.16 |

TABLE 4

| | Alloy No. | Shape | 0.2% proof stress (MPa) | Hot workability | Stress corrosion cracking resistance | N × P/REM |
|---|---|---|---|---|---|---|
| The comparative | A | plate | 862 | ○ | ○ | (0) |
| | B | plate | 1011 | X | X | (0) |
| | C | plate | 1083 | X | X | (0) |
| | D | plate | 1034 | X | X | (1.10) |
| | E | plate | 1050 | X | X | (2.09) |
| | F | plate | 995 | X | X | (0.46) |
| | G | plate | 988 | X | ○ | (0.01) |
| | H | plate | 1003 | X | X | (0.09) |
| | I | plate | 1027 | X | X | (0.16) |
| | J | plate | 1030 | X | X | (0.21) |
| | K | plate | 1048 | ○ | X | (0.11) |
| | L | plate | 1043 | ○ | X | 0.46 |
| | M | plate | 1031 | ○ | X | 0.43 |
| | N | plate | 1030 | ○ | X | 0.48 |
| | O | plate | 1152 | ○ | X | 0.54 |
| | P | plate | 994 | ○ | X | 0.53 |
| | Q | plate | 1042 | ○ | X | 0.62 |
| | R | plate | 1074 | ○ | X | 0.76 |
| | S | plate | 1155 | ○ | X | 0.90 |

As shown in Table 3, all the alloy materials (Alloy Nos. 1 to 29, 30-a, and 30-b) serving as the present invention satisfy the formula (1), and possess satisfactory hot workability and stress corrosion resistance. The 0.2% proof stress values for Alloy Nos. 30-a and 30-b of the present invention were substantially identical to one another. These results show that the pipe materials have substantially the same performance as the plate materials produced by the method described in the example.

Alloy No. A of the comparative, however, has low strength (0.2% proof stress) even though the hot workability and stress corrosion cracking resistance are good, because the N content is out of scope defined in the present invention. Alloy Nos. B and C of the comparative possess poor hot workability and stress corrosion cracking resistance because no REM are contained, even though the N content was increased for the purpose of increasing the 0.2% proof stress. Alloy Nos. D to F of the comparative have poor stress corrosion cracking resistance because of deficiencies of the content of REM. Conversely, Alloy No. G of the comparative has poor hot workability because of an excessive content of REM. Alloy Nos. H to J of the comparative have poor hot workability and stress corrosion cracking resistance because of deficiencies of the Al content, Alloy No. K of the comparative has poor stress corrosion cracking resistance because of a deficiency of the Ni content. Alloy Nos. L to S of the comparative have poor stress corrosion cracking resistance because the formula (1) is not satisfied, even though the individual chemical components fall within the chemical composition range defined in the present invention.

INDUSTRIAL APPLICABILITY

The high strength Cr—Ni alloy material according to the present invention possesses excellent hot workability and stress corrosion cracking resistance as well as high strength. The high strength Cr—Ni alloy material according to the invention can be used to drill deep oil or gas wells in severely corrosive environments, which were impossible to drill using the material of the conventional art. The high strength Cr—Ni alloy material according to the present invention can also be used for oil well seamless pipes that are inexpensive due to pipe thinning. The high strength Cr—Ni alloy material according to the present invention therefore greatly contributes to obtaining a stable energy supply.

Figure 1:
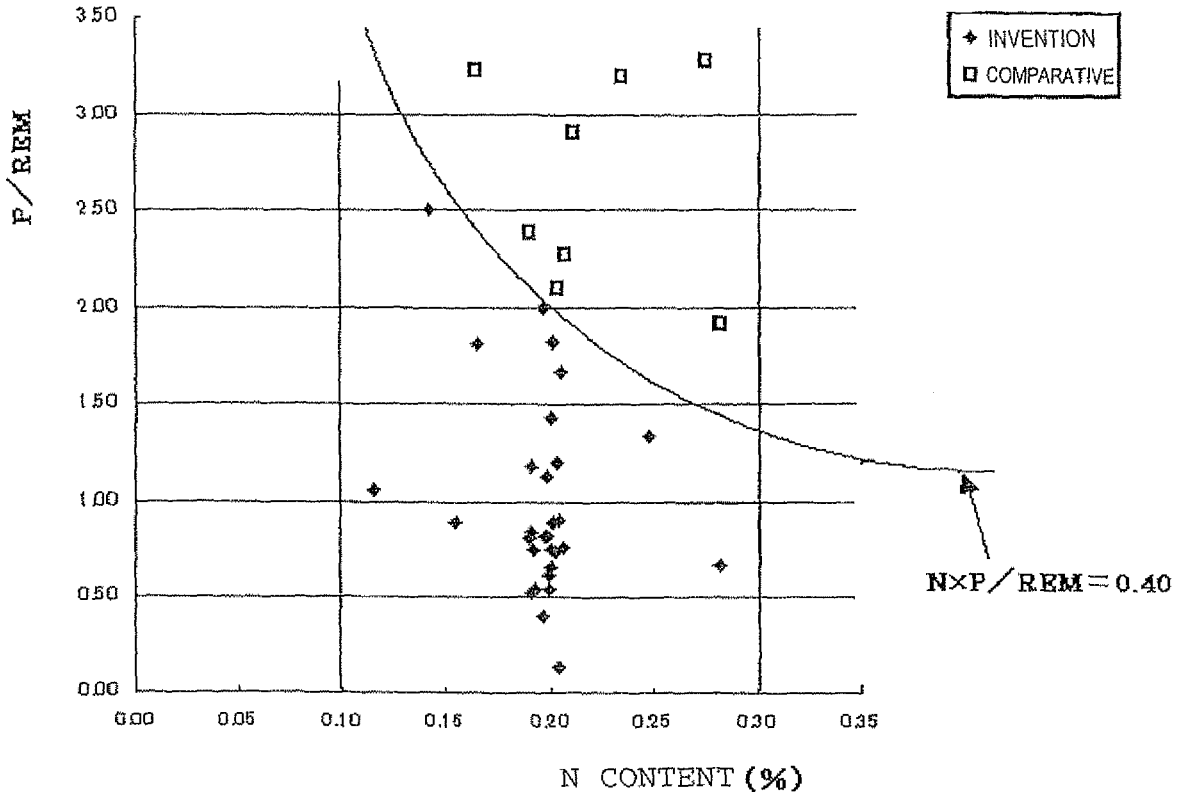
FIG. 1 is a graph of Cr—Ni alloy materials of the various chemical compositions utilized in the example, whose N content is plotted along X axis and [P/REM], content ratio of P to REM, is plotted along the Y axis.

The invention claimed is:

1. A high strength Cr—Ni alloy material which consists of, by mass percent, C: 0.05% or less, Si: 0.05 to 1.0%, Mn: 0.01% to 1.0%, P: 0.05% or less, S: 0. 005% or less, Cu: 0.1 to 4%, Ni: 25% or more and less than 33%, Cr: 20 to 30%, Mo: 0.01% or more and less than 3.5%, N: 0.10 to 0.30%, Al: 0.10 to 0.30%, O (oxygen): 0.01% or less, and REM (rare earth metal): 0.01 to 0.20%, with the balance being Fe and impurities, and also satisfies the conditions in the following formula (1).

$$N \times P/\mathrm{REM} \leqq 0.40 \qquad \text{formula (1)}$$

where P, N, and REM in the formula (1) respectively denote the contents (mass %) of P, N, and REM.

2. The high strength Cr—Ni alloy material according to claim 1, characterized by further, instead of part of Fe, containing, by mass percent, one or more selected from the first to third groups below:

the first group: W at less than 8.0%, the second group: one or more selected from Ti, Nb, Zr, and V at a total of 0.5% or less, the third group: either or both selected from Ca and Mg at a total of 0.01% or less.

3. The high strength Cr—Ni alloy material according to claim 1, in which the high strength Cr—Ni alloy material has a yield strength of 900 MPa or more at 0.2% proof stress after cold working.

4. The high strength Cr—Ni alloy material according to claim 2, in which the high strength Cr—Ni alloy material has a yield strength of 900 MPa or more at 0.2% proof stress after cold working.

5. An oil well seamless pipe made of the high strength Cr—Ni alloy material according to claim 1.

6. An oil well seamless pipe made of the high strength Cr—Ni alloy material according to claim 2.

7. An oil well seamless pipe made of the high strength Cr—Ni alloy material according to claim 3.

8. An oil well seamless pipe made of the high strength Cr—Ni alloy material according to claim 4.

* * * * *